US009372441B1

(12) United States Patent
Miyashima

(10) Patent No.: US 9,372,441 B1
(45) Date of Patent: Jun. 21, 2016

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Atsushi Miyashima, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/689,147

(22) Filed: Apr. 17, 2015

(51) Int. Cl.
*G03G 15/08* (2006.01)

(52) U.S. Cl.
CPC ..... *G03G 15/0877* (2013.01); *G03G 15/0875* (2013.01)

(58) Field of Classification Search
CPC ..... G03G 15/0877; G03G 15/0875; G03G 21/10; G03G 21/105; G03G 21/0064
See application file for complete search history.

(56) References Cited

U.S. PATENT DOCUMENTS 3,954,331 A * 5/1976 Smith ..... G03G 15/0868 222/DIG. 1
3,958,878 A * 5/1976 Smith ..... G03G 15/0868 15/1.51
4,862,226 A * 8/1989 Imaizumi ..... G03G 21/12 141/84
5,182,601 A * 1/1993 Hodoshima ..... G03G 15/09 399/258
7,450,880 B1 * 11/2008 Estabrooks ..... G03G 21/10 399/109

* cited by examiner

*Primary Examiner* — David Gray
*Assistant Examiner* — Sevan A Aydin
(74) *Attorney, Agent, or Firm* — Amin, Turocy & Watson LLP

(57) ABSTRACT

In accordance with an embodiment, an image forming apparatus comprises a toner cartridge, a toner recovery container, a toner cartridge inserting section and a toner recovery container inserting section. The toner cartridge houses the toner to be supplied to a photoconductor. The toner recovery container houses the toner recovered from the photoconductor at least. The toner cartridge inserting section is used to insert the toner cartridge detachably. The toner recovery container inserting section is used to insert the toner recovery container detachably. The toner recovery container is detachably inserted into the toner cartridge inserting section to supply the toner in the toner recovery container to the photoconductor.

8 Claims, 3 Drawing Sheets

IMAGE FORMING APPARATUS

FIELD

Embodiments described herein relate generally to an image forming apparatus.

BACKGROUND

There is an image forming apparatus which conveys a sheet-like medium (hereinafter collectively referred to as a "sheet material") such as paper and the like, and meanwhile, forms an image on the sheet material. The image forming apparatus is provided with a toner cartridge and a toner recovery container. The toner cartridge houses the toner to be supplied to a photoconductor. The toner recovery container houses the toner recovered from the photoconductor. In addition, the toner recovery container houses the toner recovered from a transfer belt. Conventionally, the toner cartridge and the toner recovery container are formed into different shapes. Thus, development costs must be paid for each of the toner cartridge and the toner recovery container. As a result, the manufacturing cost of the image forming apparatus is increased.

DETAILED DESCRIPTION

In accordance with an embodiment, an image forming apparatus comprises a toner cartridge, a toner recovery container, a toner cartridge inserting section and a toner recovery container inserting section. The toner cartridge houses the toner for developing to be supplied to a photoconductor. The toner recovery container houses the toner recovered from the photoconductor. In addition, the toner recovery container houses the toner recovered from a transfer belt. The toner cartridge inserting section is used to insert the toner cartridge detachably. The toner recovery container inserting section is used to insert the toner recovery container detachably. The toner recovery container is detachably inserted into the toner cartridge inserting section to supply the toner to the photoconductor. The toner cartridge in which the toner becomes empty is detachably inserted into the toner recovery container inserting section to house the toner recovered from the photoconductor.

Hereinafter, an image forming apparatus 1 according to the embodiment is described with reference to the accompanying drawings.

Figure 1:
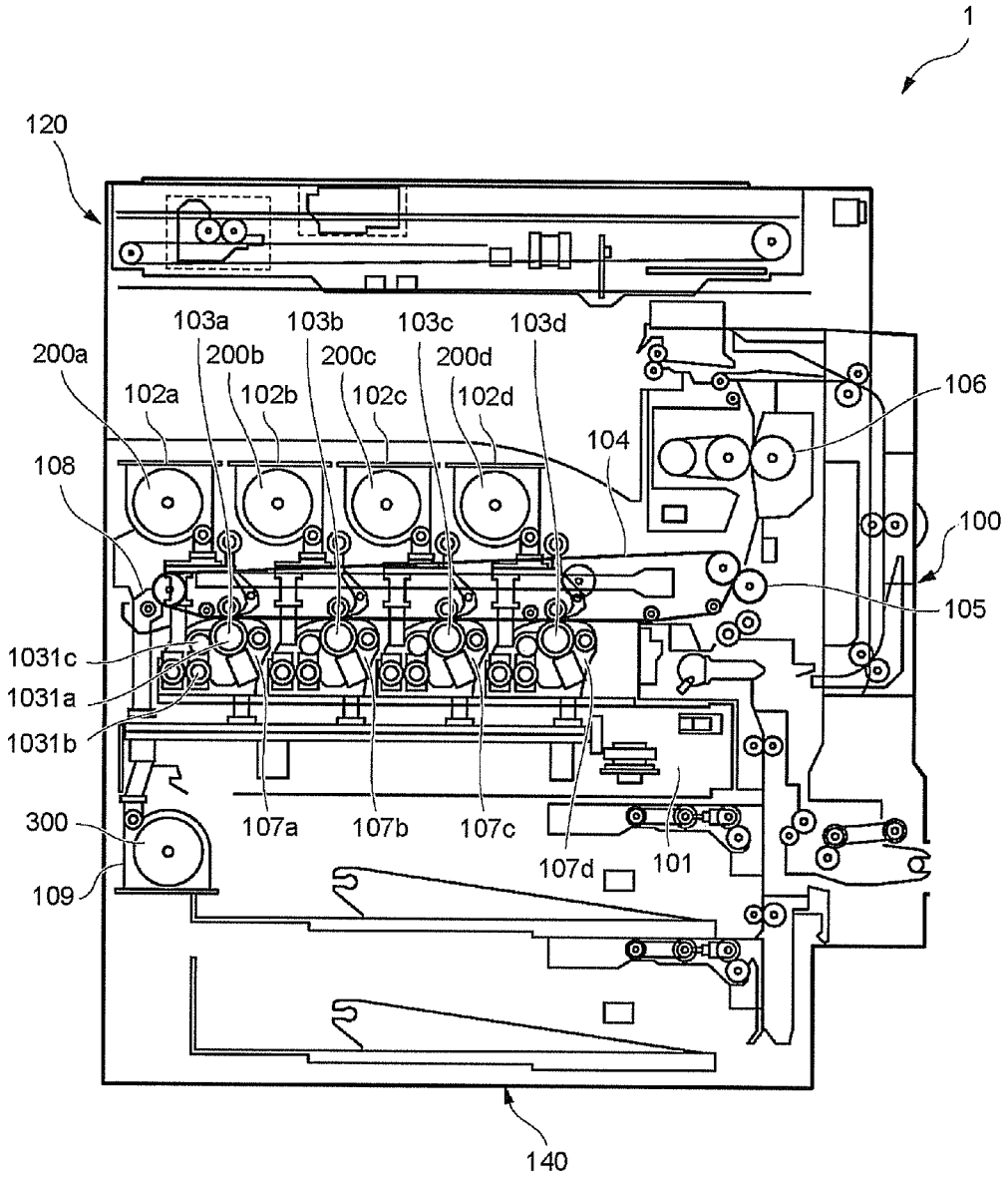
FIG. 1 is a perspective front view illustrating an example of the whole constitution of an image forming apparatus according to an embodiment.

FIG. 1 is a perspective front view illustrating an example of the whole constitution of the image forming apparatus 1 according to the embodiment. Hereinafter, the side of the image forming apparatus 1 as indicated in FIG. 1 is referred to as the front side, and the side opposite to the front side is referred to as the rear side.

As shown in FIG. 1, the image forming apparatus 1 includes an image forming section 100, an image reading section 120 and a sheet material housing section 140.

The image reading section 120 reads image information of a copy object as the brightness and darkness of light. The image reading section 120 generates data of the image to be formed on the sheet material by the image forming section 100 based on the read image information.

The sheet material housing section 140 supplies the sheet material one by one to the image forming section 100 at the timing when an output image is formed by the image forming section 100.

The image forming section 100 forms the output image on the sheet material based on the image data. The image data may be generated by the image reading section 120, or supplied from an external device. The image data supplied from the external device may be supplied through a network, or supplied by a storage medium connected with the image forming apparatus 1.

The image forming section 100 forms the image on the surface of the sheet material with toner based on the image data.

The image forming section 100 includes an exposure device 101, toner cartridge inserting sections 102*a*, 102*b*, 102*c* and 102*d*, monochrome image forming sections 103*a*, 103*b*, 103*c* and 103*d*, an intermediate transfer belt 104, a sheet transfer device 105, a fixing device 106, photoconductive drum cleaners 107*a*, 107*b*, 107*c* and 107*d*, an intermediate transfer belt cleaner 108 and a toner recovery container inserting section 109.

Toner cartridges 200*a*, 200*b*, 200*c* and 200*d* each of which houses cyan toner, magenta toner, yellow toner and black toner are inserted into the toner cartridge inserting sections 102*a*, 102*b*, 102*c* and 102*d*, respectively. The toner cartridge inserting sections 102*a*, 102*b*, 102*c* and 102*d* are spaces where the toner cartridges can be detachably inserted. The toner cartridge inserted into each of the toner cartridge inserting sections 102*a*, 102*b*, 102*c* and 102*d* supplies the toner. Each of the toner cartridges 200*a*, 200*b*, 200*c* and 200*d* supplies the toner to the monochrome image forming sections 103*a*, 103*b*, 103*c* and 103*d*, respectively.

Each of the monochrome image forming sections 103*a*, 103*b*, 103*c* and 103*d* forms monochrome images of cyan, magenta, yellow and black on the intermediate transfer belt 104, respectively. Each of the monochrome image forming sections 103*a*, 103*b*, 103*c* and 103*d* includes a photoconductive drum, a developing device and a transfer device. Hereinafter, a photoconductive drum 1031*a*, a developing device 1032*a* and a transfer device 1033*a* of the monochrome image forming section 103*a* is described. As the monochrome image forming section 103*a* is the same as the monochrome image forming sections 103*b*, 103*c* and 103*d* in the constitution, and therefore the repetitive description is not provided.

The photoconductive drum 1031*a* maintains an electrostatic latent image generated through the laser light irradiated by the exposure device 101. The exposure device 101 irradiates the photoconductive drum 1031*a* with laser light. The intensity of the laser light irradiated by the exposure device 101 is set according to the brightness and darkness of image data of each color. In this way, the electrostatic latent image corresponding to the image data is formed on the surface of each photoconductive drum 1031*a*. The developing device 1032*a* supplies toner to the surface of the photoconductive drum 1031*a* where the electrostatic latent image is maintained to form a toner image on the surface of the photoconductive drum 1031*a*. The transfer device 1033*a* transfers the toner image formed on the surface of the photoconductive drum 1031*a* to the intermediate transfer belt 104.

The intermediate transfer belt 104 conveys the toner image formed by each of the monochrome image forming sections 103*a*, 103*b*, 103*c* and 103*d*.

The sheet transfer device 105 transfers the toner image conveyed by the intermediate transfer belt 104 to the sheet material supplied from the sheet material housing section 140.

The fixing device 106 applies heat and pressure to the toner image transferred to the surface of the sheet material to fix the toner image on the sheet material.

Each of the photoconductive drum cleaners 107*a*, 107*b*, 107*c* and 107*d* collects the waste toner (the toner that is not used in the formation of the toner image) from the photoconductive drum of each monochrome image forming section 103*a*, 103*b*, 103*c* and 103*d*.

The intermediate transfer belt cleaner 108 collects the waste toner from the intermediate transfer belt 104.

A toner recovery container 300 (refer to FIG. 3) is inserted into the toner recovery container inserting section 109. The toner recovery container inserting section 109 is a space where the toner recovery container can be detachably inserted. The waste toner is replenished to the toner recovery container inserted into the toner recovery container inserting section 109. The toner recovery container 300 recovers the waste toner collected by the photoconductive drum cleaners 107*a*, 107*b*, 107*c* and 107*d*.

Hereinafter, the constitution of the toner cartridge 200 is described with reference to FIG. 2.

Figure 2:
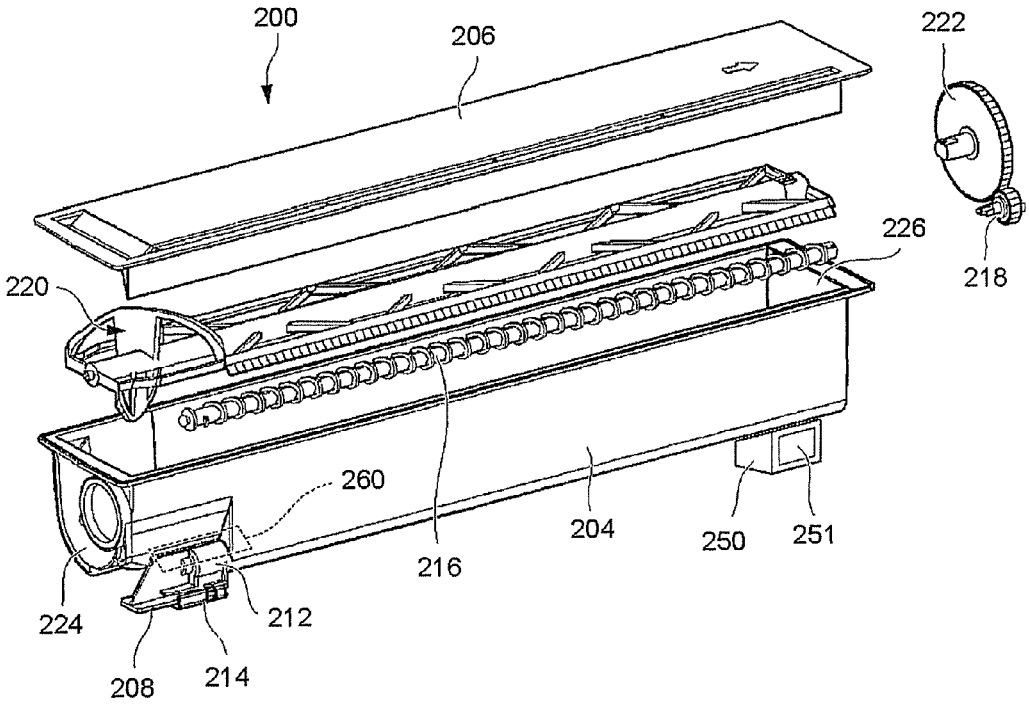
FIG. 2 is an exploded perspective view illustrating an example of the constitution of a toner cartridge of the image forming apparatus according to the embodiment.

FIG. 2 is an exploded perspective view of the toner cartridge 200. The toner cartridge 200 includes a case 204, a lid 206, a shutter guide 208, a toner supply section 212, a shutter 214, a toner conveyance auger 216, a toner conveyance auger driving gear 218, a toner stirring paddle 220, a toner stirring paddle gear 222, a front wall 224, a rear wall 226 and a window part 250.

The case 204 houses the toner. When seen from a direction from the front side (the side where there is the front wall 224) towards the rear side (the side where there is the rear wall 226), the bottom surface of the case 204 is formed into a U-shape.

The toner supply section 212 is arranged on the bottom surface of the case 204. The toner supply section 212 is, for example, arranged at the front side of the case 204. On the bottom surface of the toner supply section 212 is arranged a toner supply port 260. The toner supply port 260 is an opening for supplying the toner housed in the case 204 to the image forming section 100. The toner housed in the toner cartridge 200 which is inserted into each of the toner cartridge inserting sections 102*a*, 102*b*, 102*c* and 102*d* is supplied to each of the monochrome image forming sections 103*a*, 103*b*, 103*c* and 103*d* through the toner supply port 260 of each toner cartridge (refer to FIG. 1).

The shutter 214 and the shutter guide 208 are arranged in the toner supply section 212. The shutter guide 208 extends from the rear side to the front side. The shutter 214 slides along the shutter guide 208 between the rear side and the front side. When the shutter 214 arrives at the rear side, the toner supply port 260 is closed. When the shutter 214 arrives at the front side, the toner supply port 260 is opened.

In the shutter guide 208 is arranged an energization member (not shown) such as a spring, a rubber and the like. The energization member applies an energization force to the shutter 214 in a direction in which the shutter 214 is moved to the rear position along the shutter guide 208.

When the toner cartridge 200 isn't inserted into any of the toner cartridge inserting sections 102*a*, 102*b*, 102*c* and 102*d*, the shutter 214 is moved to the rear side through the energization force of the energization member. As a result, the toner supply port 260 is closed.

When the toner cartridge 200 is inserted into each of the toner cartridge inserting sections 102*a*, 102*b*, 102*c* and 102*d*, the shutter 214 is engaged with a pawl part (not shown) arranged in each of the toner cartridge inserting sections 102*a*, 102*b*, 102*c* and 102*d*, and is moved to the front side to be fixed. As a result, the toner supply port 260 is opened, and is possible to supply toner.

The toner conveyance auger 216 is a rod shape member, and is supported by the front wall 224 and the rear wall 226 at the two ends thereof. A spiral rotary blade is arranged along the axis direction of the toner conveyance auger 216. The toner conveyance auger 216 is rotated around the axis thereof, and in this way, the object (such as powdery solid, liquid and the like) that coats the toner conveyance auger 216 is extruded through the rotary blade, and is conveyed along the axis direction.

The toner conveyance auger driving gear 218 is connected with the end at the rear side of the toner conveyance auger 216. If the toner conveyance auger driving gear 218 rotates the toner conveyance auger 216 forward (for example, rotates clockwise when seen from the front side), the toner conveyance auger 216 conveys the toner from the innermost side of the case 204 to the toner supply section 212 at the front side.

The toner stirring paddle 220 rotates along the U-shape bottom surface of the case 204. The toner stirring paddle 220 stirs the toner in the case 204.

The toner stirring paddle driving gear 222 is connected with the end at the rear side of the toner stirring paddle 220. The toner stirring paddle gear 222 is meshed with the gear teeth engraved on the outer periphery of the toner conveyance auger driving gear 218. When the toner conveyance auger driving gear 218 rotates clockwise when seen from the front side, the toner stirring paddle gear 222 that is rotated anticlockwise when seen from the front side rotates the toner stirring paddle 220 anticlockwise when seen from the front side. Further, the toner stirring paddle gear 222 may rotate independent from the toner conveyance auger driving gear 218.

The window part 250 is arranged on part of the bottom surface of the case 204. The window part 250 juts out from the bottom surface of the case 204 to the outside. The window part 250 is a small space that is formed at a further position than the bottom surface of the case 204. The window part 250 is, for example, arranged at the rear side of the case 204.

A window 251 is arranged on the lateral surface of the window part 250. The inside of the window part 250 can be seen through the window 251.

When filling toner into the case 204, the window part 250 is filled with the toner. The toner in the toner cartridge 200 is conveyed to the outside of the toner cartridge 200 through the toner conveyance auger 216. During this conveying process, the rotary blade of the toner conveyance auger 216 cannot reach the inside of the window part 250, and thus the toner in the window part 250 is remained. Thus, during the period when the toner cartridge 200 is inserted into each of the toner cartridge inserting sections 102*a*, 102*b*, 102*c* and 102*d*, a later-described detection module can detect the color of the toner inside the case 204 through the window 251.

When the toner cartridge 200 is inserted into each of the toner cartridge inserting sections 102*a*, 102*b*, 102*c* and 102*d*, the image forming apparatus 1 (refer to FIG. 1) can be provided with an image capturing element or a photodetector (detection module) that views the inside of the case 204 through the window 251.

Hereinafter, the constitution of the toner recovery container 300 is described with reference to FIG. 3.

Figure 3:
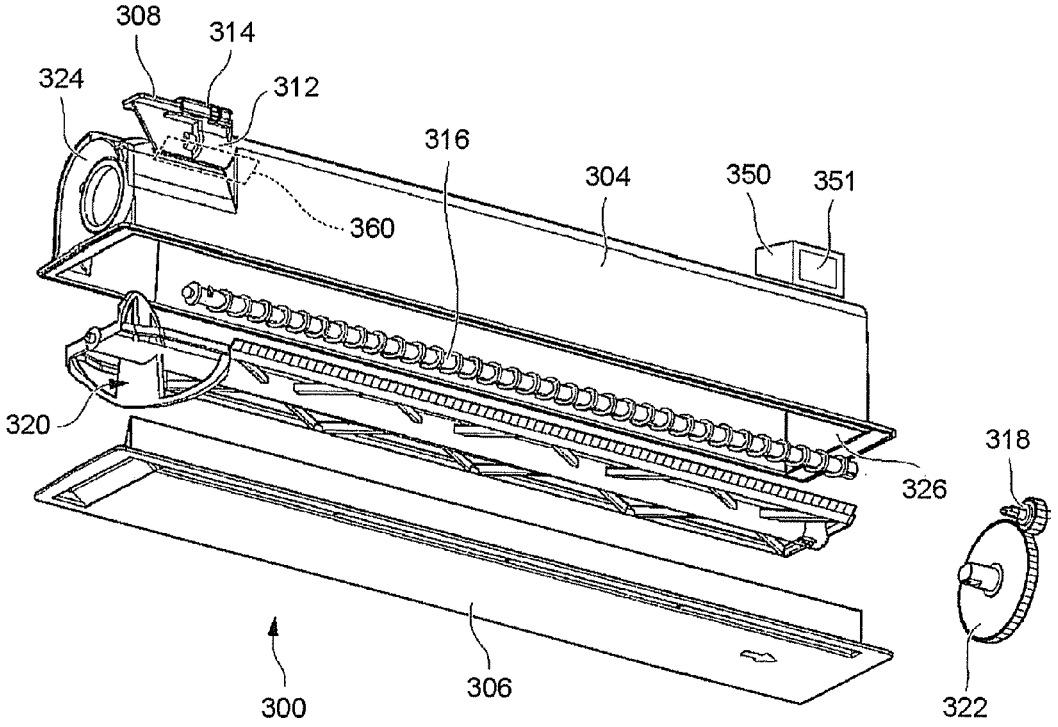
FIG. 3 is an exploded perspective view illustrating an example of the constitution of a toner recovery container of the image forming apparatus according to the embodiment.

FIG. 3 is an exploded perspective view of the toner recovery container 300. The toner recovery container 300 includes a case 304, a lid 306, a shutter guide 308, a toner replenishing section 312, a shutter 314, a toner conveyance auger 316, a toner conveyance auger driving gear 318, a toner stirring paddle 320, a toner stirring paddle gear 322, a front wall 324, a rear wall 326 and a window part 350.

The case 304 houses the waste toner. When seen from a direction from the front side (the side where there is the front wall 324) towards the rear side (the side where there is the rear wall 326), the ceiling plane of the case 304 is formed into an inverted U-shape.

A toner replenishing section 312 is arranged on the ceiling plane of the case 304. The toner replenishing section 312 is, for example, arranged at the front side of the case 304. On the ceiling plane of the toner replenishing section 312 is arranged a toner replenishing port 360. The toner replenishing port 360 is an opening for recovering the waste toner housed in the case 304 from the image forming section 100. The waste toner collected by the photoconductive drum cleaners 107*a*, 107*b*, 107*c* and 107*d* and the intermediate transfer belt cleaner 108 is to be recovered in the toner recovery container 300 that is inserted into the toner recovery container inserting section 109 through the waste toner replenishing port of the waste toner recovery container 300 (refer to FIG. 1).

The shutter 314 and the shutter guide 308 are arranged in the toner replenishing section 312. The shutter guide 308 extends from the rear side to the front side. The shutter 314 slides along the shutter guide 308 between the rear side and the front side. When the shutter 314 arrives at the rear side, the toner replenishing port 360 is closed. When the shutter 314 arrives at the front side, the toner replenishing port 360 is opened.

In the shutter guide 308 is arranged an energization member (not shown) such as a spring, a rubber and the like. The energization member applies an energization force to the shutter 314 in a direction in which the shutter 314 is moved to the rear position along the shutter guide 308.

When the toner recovery container 300 isn't inserted into the toner recovery container inserting section 109, the shutter 314 is moved to the rear side through the energization force of the energization member. As a result, the toner replenishing port 360 is closed.

When the toner recovery container 300 is inserted into the toner recovery container inserting section 109, the shutter 314 is engaged with a pawl part (not shown) arranged in the toner recovery container inserting section 109, and is moved to the front side to be fixed. As a result, the toner replenishing port 360 is opened, and is possible to recover the waste toner.

The toner conveyance auger 316 is a rod shape member, and is supported by the front wall 324 and the rear wall 326 at the two ends thereof. A spiral rotary blade is arranged along the axis direction of the toner conveyance auger 316. The toner conveyance auger 316 is rotated around the axis thereof, and in this way, the object (such as powdery solid, liquid and the like) that coats the toner conveyance auger 316 is extruded through the rotary blade, and is conveyed along the axis direction.

The toner conveyance auger driving gear 318 is connected with the end at the rear side of the toner conveyance auger 316. If the toner conveyance auger driving gear 318 rotates the toner conveyance auger 316 backward (for example, rotates anticlockwise when seen from the front side), the toner conveyance auger 316 conveys the waste toner from the waste toner replenishing section 312 at the front side to the innermost side of the case 304.

The toner stirring paddle 320 rotates along the U-shape ceiling plane of the case 304. The toner stirring paddle 320 stirs the toner in the case 304.

The toner stirring paddle driving gear 322 is connected with the end at the rear side of the toner stirring paddle 320. The toner stirring paddle gear 322 is meshed with the gear teeth engraved on the outer periphery of the toner conveyance auger driving gear 318. When the toner conveyance auger driving gear 318 rotates anticlockwise when seen from the front side, the toner stirring paddle gear 322 that is rotated clockwise when seen from the front side rotates the toner stirring paddle 320 clockwise when seen from the front side. Further, the toner stirring paddle gear 322 may rotate independent from the toner conveyance auger driving gear 318.

The window part 350 is arranged on part of the ceiling plane of the case 304. The window part 350 juts out from the ceiling plane of the case 304 to the outside. The window part 350 is a small space that is formed at a higher position than the ceiling plane of the case 304. The window part 350 is, for example, arranged at the rear side of the case 304.

A window 351 is arranged on the lateral surface of the window part 350. The inside of the window part 350 can be seen through the window 351.

When the toner recovery container 300 is empty, the window part 350 isn't filled with the waste toner. When the toner recovery container 300 recovers the waste toner, the waste toner is conveyed to the inside (rear side) of the toner recovery container 300 through the toner conveyance auger 316. As the waste toner is recovered, the waste toner is sequentially filled into the toner recovery container 300 from the rear side. When the rear side of the toner recovery container 300 is completely filled with waste toner, the inside of the window part 350 is filled with the waste toner for the first time. Thus, the presence/absence of the waste toner is detected by a later-described detection module through the window 351, and in this way, it is possible to determine whether or not the waste toner recovery container 300 is filled with the waste toner (that is, whether or not the toner recovery container 300 should be exchanged).

When the toner recovery container 300 is inserted into the toner recovery container inserting section 109, the image forming apparatus 1 (refer to FIG. 1) can be provided with an image capturing element or a photoconductor (detection module) that views the inside of the case 304 through the window 351.

The toner recovery container 300 and the toner cartridge 200 are formed into the same shape. The case 304 and the case 204, the lid 306 and the lid 206, the shutter guide 308 and the shutter guide 208, the toner replenishing section 312 and the toner, supply section 212, the shutter 314 and the shutter 214, the toner conveyance auger 316 and the toner conveyance auger 216, the toner conveyance auger driving gear 318 and the toner conveyance auger driving gear 218, the toner stirring paddle 320 and the toner stirring paddle 220, the toner stirring paddle gear 322 and the toner stirring paddle gear 222, the front wall 324 and the front wall 224, the rear wall 326 and the rear wall 226, the window part 350 and the window part 250, each of which is formed by the same component. Thus, when turning the toner recovery container 300 upside down, the toner recovery container 300 can be detachably inserted into each of the toner cartridge inserting sections 102*a*, 102*b*, 102*c* and 102*d*. Further, when turning the toner cartridge 200 in which the toner becomes empty upside down, the toner cartridge 200 can be detachably inserted into the toner recovery container inserting section 109.

Each of the cyan toner, the magenta toner, the yellow toner and the black toner is recovered in the same toner recovery container 300 as waste toner. Thus, the color of the waste toner in the toner recovery container is brown to black as a whole. Thus, for example, the toner recovery container 300 filled with the waste toner is inserted into the black toner cartridge inserting section 102*d* to supply the waste toner to the photoconductive drum of the monochrome image forming section 103*d*, and in this way, the waste toner can be reused in the monochrome printing processing.

The image forming apparatus 1 according to the embodiment described above is provided with the toner recovery container 300. The toner recovery container 300 can be detachably inserted into each of the toner cartridge inserting sections 102*a*, 102*b*, 102*c* and 102*d*. The toner recovery container 300 supplies the waste toner to the photoconductive drum of each of the monochrome image forming sections 103*a*, 103*b*, 103*c* and 103*d*. Thus, the toner recovery container 300 may be also used as the toner cartridge 200. As a result, development costs that must be paid for each of the toner cartridge and the toner recovery container are reduced, and thus the manufacturing cost of the image forming apparatus can be reduced.

The toner recovery container 300 is provided with the toner conveyance auger driving gear (rotary blade) 318. When the toner recovery container 300 is inserted into the toner recovery container inserting section 109, the toner conveyance auger driving gear 318 is rotated in a forward direction (first direction). Thus, the toner conveyance auger driving gear 318 conveys the waste toner flowed from the toner replenishing port 360 to the innermost side of the container main body. When the toner recovery container 300 is inserted into each of the toner cartridge inserting sections 102*a*, 102*b*, 102*c* and 102*d*, the toner conveyance auger driving gear 318 is rotated in a backward direction (second direction) opposite to the forward direction (first direction). Thus, the toner conveyance auger driving gear 318 conveys the waste toner housed in the innermost side of the container main body to the toner replenishing port 360. As a result, the replenishing of the waste toner and the supply of the toner used in the image formation can be carried out through the same mechanism.

The toner recovery container 300 is provided with the window part 350 through which the inside of the case (container main body) 304 can be seen. Thus, the detection module can detect whether or not the toner recovery container 300 is filled with the waste toner from outside.

The image forming apparatus 1 is provided with the toner cartridge 200. After the toner in the toner cartridge 200 becomes empty, the toner cartridge 200 is detachably inserted into the toner recovery container inserting section 109 to house the waste toner recovered from the photoconductive drum of each of the monochrome image forming sections 103*a*, 103*b*, 103*c* and 103*d*. Thus, the toner cartridge 200 can also be used as the toner recovery container 300. As a result, the material cost and the development cost of the toner recovery container are reduced, and thus the manufacturing cost of the image forming apparatus can be reduced.

The toner cartridge 200 is provided with the toner conveyance auger driving gear 218. When the toner cartridge 200 is inserted into the toner recovery container inserting section 109, the toner conveyance auger driving gear 218 is rotated in a forward direction (first direction). Thus, the toner conveyance auger driving gear 218 conveys the waste toner flowed from the toner supply port 260 to the innermost side of the container main body. When the toner cartridge 200 is inserted into each of the toner cartridge inserting sections 102*a*, 102*b*, 102*c* and 102*d*, the toner conveyance auger driving gear 218 is rotated in a backward direction (second direction) opposite to the forward direction (first direction). Thus, the toner conveyance auger driving gear 218 is provided with the rotary blade for conveying the waste toner housed in the innermost side of the container main body to the toner supply port 260. As a result, the replenishing of the waste toner and the supply of the toner used in the image formation can be carried out through the same mechanism.

The toner cartridge 200 is provided with the window part 250 through which the inside of the container main body can be seen. Thus, the detection module can detect the color of the toner housed in the toner cartridge 200 from outside.

The image forming apparatus 1 is provided with the image capturing element or the photoconductor (detection module), and thus the color of the toner housed in the toner cartridge 200 and whether or not the toner recovery container 300 is filled with the waste toner can be detected automatically.

Hereinafter, a modification of the embodiment is described.

The toner cartridge 200 according to the embodiment described above and the toner recovery container 300 are formed into the same shape. However, the present invention is not limited to this. As long as the toner cartridge 200 can be inserted into the toner recovery container inserting section 109, the toner cartridge 200 may consist of components different from those of the toner recovery container 300.

The toner recovery container 300 according to the embodiment described above and the toner cartridge 200 are formed into the same shape. However, the present invention is not limited to this. As long as the toner recovery container 300 can be inserted into each of the toner cartridge inserting sections 102*a*, 102*b*, 102*c* and 102*d*, the toner recovery container 300 may consist of components different from those of the toner cartridge 200.

In accordance with at least one embodiment described above, the image forming apparatus 1 is provided with the toner recovery container 300 that can be detachably inserted into each of the toner cartridge inserting sections 102*a*, 102*b*, 102*c* and 102*d*, the manufacturing cost of the image forming apparatus 1 can be reduced and the waste toner can be reused.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a toner cartridge configured to house the toner to be supplied to a photoconductor;

a toner recovery container configured to house the toner recovered from the photoconductor at least;

a toner cartridge inserting section configured to be used to insert the toner cartridge detachably; and a toner recovery container inserting section configured to be used to insert the toner recovery container detachably, wherein the toner recovery container is detachably inserted into the toner cartridge inserting section to supply the toner in the toner recovery container to the photoconductor;

the toner recovery container includes a container main body which houses the toner, a spiral rotary blade which is supported by the inner wall surfaces of the container main body at the two ends thereof, and a toner replenishing port which is arranged at one end in the rotation axial direction of the rotary blade in the container main body;

when the toner recovery container is inserted into the toner recovery container inserting section, the rotary blade is rotated in a first direction and the toner flowed from the toner replenishing port is conveyed to the innermost side of the container main body; and when the toner recovery container is inserted into the toner cartridge inserting section, the rotary blade is rotated in a second direction opposite to the first direction and the toner housed in the innermost side of the container main body is conveyed to the toner replenishing port.

2. The image forming apparatus according to claim 1, wherein a window part through which the inside of the container main body can be seen is arranged in the container main body.

3. The image forming apparatus according to claim 2, further comprising:

a first detection module configured to detect, through the window part, the housing state of the toner housed in the toner recovery container that is inserted into the toner recovery container inserting section.

4. The image forming apparatus according to claim 3, further comprising:

a second detection module configured to detect, through the window part, the housing state of the toner housed in the toner recovery container that is inserted into the toner cartridge inserting section.

5. An image forming apparatus, comprising:

a toner cartridge configured to house the toner for developing to be supplied to a photoconductor;

a toner recovery container configured to house the toner recovered from the photoconductor;

a toner cartridge inserting section configured to be used to insert the toner cartridge detachably; and a toner recovery container inserting section configured to be used to insert the toner recovery container detachably, wherein the toner cartridge in which the toner becomes empty is detachably inserted into the toner recovery container inserting section to house the toner recovered from the photoconductor;

the toner cartridge includes a container main body which houses the toner, a spiral rotary blade which is supported by the inner wall surfaces of the container main body at the two ends thereof, and a toner supply port which is arranged at one end in the rotation axial direction of the rotary blade in the container main body;

when the toner cartridge is inserted into the toner recovery container inserting section, the rotary blade is rotated in a first direction and the toner flowed from the toner supply port is conveyed to the innermost side of the container main body; and when the toner cartridge is inserted into the toner cartridge inserting section, the rotary blade is rotated in a second direction opposite to the first direction and the toner housed in the innermost side of the container main body is conveyed to the toner supply port.

6. The image forming apparatus according to claim 5, wherein a window part through which the inside of the container main body can be seen is arranged in the container main body.

7. The image forming apparatus according to claim 6, further comprising:

a first detection module configured to detect, through the window part, the housing state of the toner housed in the toner cartridge that is inserted into the toner recovery container inserting section.

8. The image forming apparatus according to claim 7, further comprising:

a second detection module configured to detect, through the window part, the housing state of the toner housed in the toner cartridge that is inserted into the toner cartridge inserting section.

* * * * *